US009648911B2

(12) United States Patent
Welsch et al.

(10) Patent No.: US 9,648,911 B2
(45) Date of Patent: May 16, 2017

(54) GARMENT WITH BACK STAYS FOR ENHANCED FIT

(71) Applicant: Cupid Foundations, Inc., New York, NY (US)

(72) Inventors: David Welsch, Livingston, NJ (US); Anthony Angelino, Edmond, OK (US); Nancy S. Miller, Quakertown, PA (US); Jennie M. Aburto, Bethlehem, PA (US)

(73) Assignee: Cupid Foundations, Inc., New York, NY (US)

( * ) Notice: Subject to any disclaimer, the term of this patent is extended or adjusted under 35 U.S.C. 154(b) by 23 days.

(21) Appl. No.: 14/631,253

(22) Filed: Feb. 25, 2015

(65) Prior Publication Data

US 2015/0245670 A1 Sep. 3, 2015

Related U.S. Application Data

(60) Provisional application No. 61/946,260, filed on Feb. 28, 2014.

(51) Int. Cl.

| | |
|---|---|
| ***A41C 1/06*** | (2006.01) |
| ***A41C 1/14*** | (2006.01) |
| ***A41C 1/00*** | (2006.01) |
| *A41C 3/06* | (2006.01) |

(52) U.S. Cl.

CPC ..... *A41C 1/14* (2013.01); *A41C 1/00* (2013.01); *A41C 1/003* (2013.01); *A41C 1/06* (2013.01); *A41C 3/06* (2013.01)

(58) Field of Classification Search

CPC .... A41C 3/00; A41C 1/00; A41C 3/06; A41C 1/06; A41C 3/0007; A41C 3/065

USPC ..... 450/41–51, 81, 54–57, 107, 109, 143, 450/144; 2/255–261.1

See application file for complete search history.

(56) References Cited

U.S. PATENT DOCUMENTS

| | | | | |
|---|---|---|---|---|
| 458,262 | A * | 8/1891 | Swartwout ..... | A41C 3/0007 2/112 |
| 1,889,285 | A * | 11/1932 | Hart ..... | A41C 1/06 450/155 |
| 2,088,423 | A | 7/1937 | Kispert | |
| 2,136,742 | A | 11/1938 | Herbener | |

(Continued)

FOREIGN PATENT DOCUMENTS

| | | | |
|---|---|---|---|
| GB | 492485 | A | 9/1938 |
| GB | 2086712 | A | 5/1982 |

OTHER PUBLICATIONS

International Search Report and Written Opinion for Application No. PCT/US2015/017486 dated Aug. 4, 2015.

(Continued)

*Primary Examiner* — Gloria Hale
(74) *Attorney, Agent, or Firm* — Lerner, David, Littenberg, Krumholz & Mentlik, LLP

(57) ABSTRACT

A shapewear or activewear garment that includes stays carried by the back fabric panel of the garment. In this regard, the stays act as anchors to keep the garment in place. Further, the stays provide tension that pulls the front fabric panel of the garment such that the front panel shapes and smoothes the wearer's midsection and or provides support and also provides resistance to shift when the garment is worn such that the garment does not ride up or down on the wearer.

32 Claims, 10 Drawing Sheets

(56) References Cited

U.S. PATENT DOCUMENTS

| | | | | | |
|---|---|---|---|---|---|
| 2,281,533 | A | | 4/1942 | Buchanan | |
| 2,288,703 | A | | 7/1942 | Herbener | |
| 2,406,893 | A | * | 9/1946 | Nunn | A41C 3/06 450/41 |
| 2,448,919 | A | * | 9/1948 | Shulman | A41C 3/06 450/41 |
| 2,524,620 | A | * | 10/1950 | Cadous | A41C 3/06 450/41 |
| 2,524,621 | A | * | 10/1950 | Cadous | A41C 3/06 450/41 |
| 2,553,036 | A | * | 5/1951 | Christensen | A41C 1/06 450/17 |
| 2,697,225 | A | * | 12/1954 | Roth | A41C 3/06 450/131 |
| 2,852,781 | A | * | 9/1958 | Ganser | A41C 1/16 2/260 |
| 2,880,732 | A | * | 4/1959 | Smith | A41C 3/06 450/51 |
| 2,900,984 | A | | 8/1959 | Cunningham | |
| 3,927,665 | A | | 12/1975 | Wax | |
| 4,983,140 | A | | 1/1991 | Gimble | |
| 5,537,690 | A | | 7/1996 | Johnson | |
| 5,765,224 | A | | 6/1998 | Johnson | |
| 5,785,672 | A | | 7/1998 | Mattison et al. | |
| 6,068,606 | A | | 5/2000 | Castel et al. | |
| 6,276,175 | B1 | | 8/2001 | Browder, Jr. | |
| 6,883,179 | B1 | | 4/2005 | Crum | |
| 7,228,809 | B2 | | 6/2007 | Angelino et al. | |
| 8,176,864 | B2 | | 5/2012 | Angelino et al. | |
| 2009/0098801 | A1 | | 4/2009 | Pedersen et al. | |
| 2011/0003533 | A1 | | 1/2011 | Caruso et al. | |
| 2011/0219514 | A1 | | 9/2011 | Scheininger | |
| 2012/0060253 | A1 | | 3/2012 | Bergin et al. | |
| 2012/0144548 | A1 | | 6/2012 | Quaranta | |

OTHER PUBLICATIONS

Partial International Search Report for Application No. PCT/US2015/017486 dated May 29, 2015.

* cited by examiner

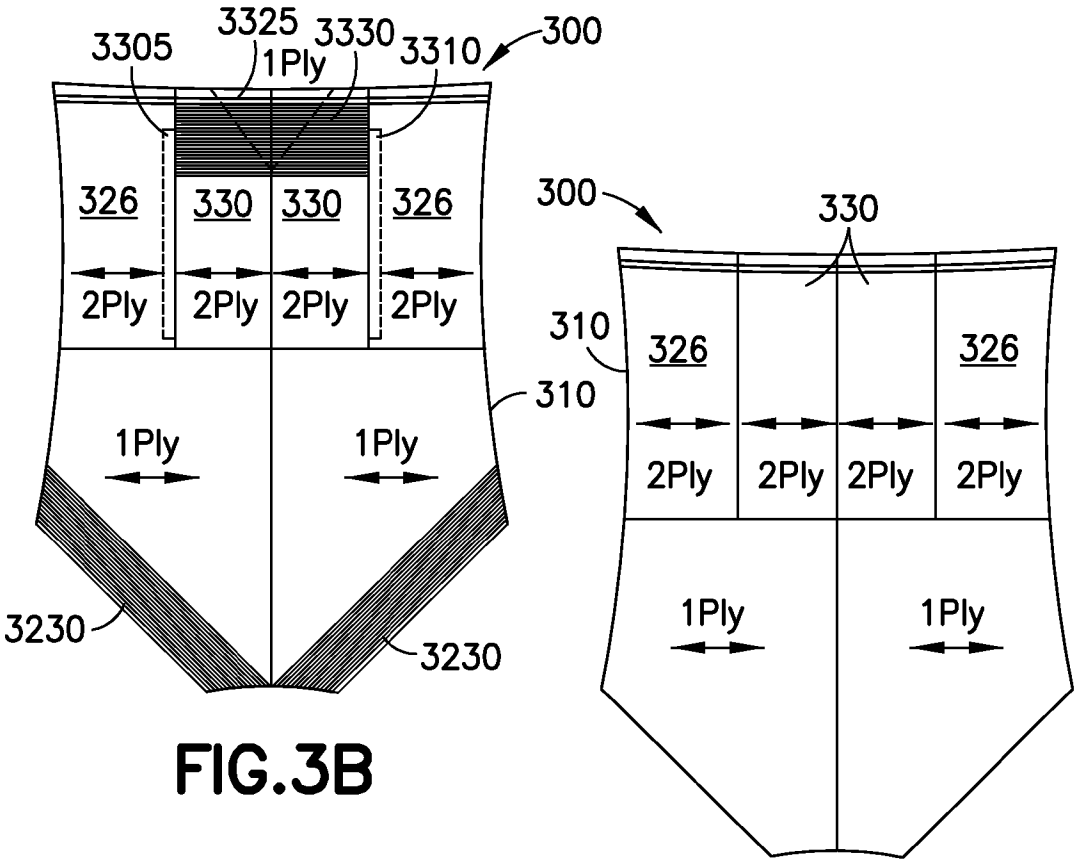
FIG.3B
FIG.3C
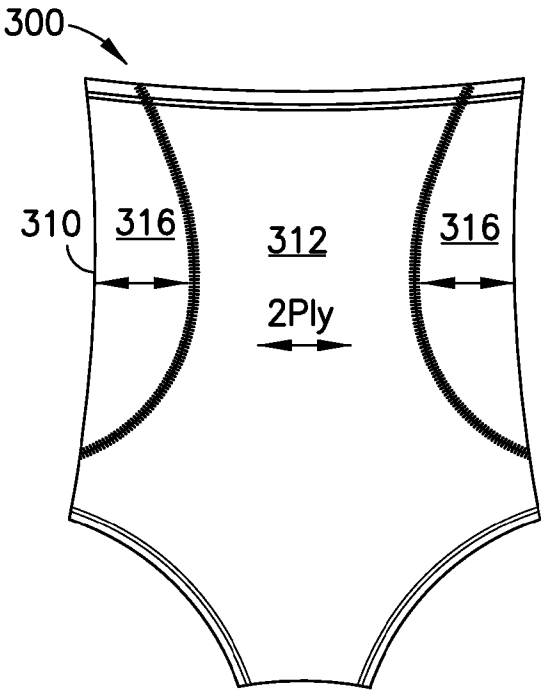
FIG.3A

GARMENT WITH BACK STAYS FOR ENHANCED FIT

CROSS-REFERENCE TO RELATED APPLICATIONS

The present invention claims the benefit of the filing date of U.S. Provisional Patent Application No. 61/946,260 filed Feb. 28, 2014, the disclosure of which is hereby incorporated by reference.

BACKGROUND OF THE INVENTION

The present invention relates to certain garments referred to as foundation garments, shapewear, activewear, brassieres, etc. The present application describes such garments that provide a smooth, stable fit that provides both a comfortable fit and an attractive shape to the wearer.

Foundation garments, such as brassieres, corsets, girdles, etc., have been used for a number of years to impart a more attractive shape to the wearer. In this regard, foundation garments have been used to enhance, control, emphasize, and reduce aspects of the figure of the wearer, often at the expense of comfort.

For example, corsets were historically used to shape and hold a wearer's midsection. Traditionally, corsets were worn around the torso to reduce the wearer's waist while emphasizing the wearer's chest and/or hips. However, corsets are notorious for restricting the wearer's chest movement, thereby making it difficult to breathe.

A more modern example of foundation garments is shapewear. Shapewear is a class of undergarments that provide shape, and control, thereby smoothing and shaping the wearer's figure. However, shapewear has a tendency to shift on the wearer's body, especially in response to movement by the wearer. For instance, waistbands of shapewear garments tend to rollover when the wearer bends over or sits down. Further, shapewear garments also have a tendency to ride-up or ride-down or otherwise shift on the wearer.

Many solutions have been proposed to address these shortcomings. However, prior attempts to provide stability to garments have been at the expense of comfort. For example, "no ride" fabrics and features often irritate the skin of the wearer or cause the wearer to sweat.

Thus, there is a need for shapewear garments that provide the desired shape and control to the wearer, yet are comfortable enough and stable enough to be worn for extended periods of time without requiring constant readjustment as the garment shifts in response to wearer movement.

BRIEF SUMMARY OF THE INVENTION

The current application describes a garment that overcomes the shortcomings in the prior art by providing a foundation garment that provides shape and support to the figure of the wearer yet is comfortable to wear for extended periods and resists roll over, moving, riding down, ride up, or otherwise shifting out of place over time when worn, even if the wearer is very active.

Garments are made of fabric. Fabric, as used herein, encompasses any type of fabric from which garments can be fashioned. Foundation garments, as used herein, are garments configured to be worn underneath clothing. Foundation garments are also referred to herein as shapewear. The fabric from which the body of the garment is formed is referred to herein as the body fabric. The individual pieces of fabric that are attached together to form the body of the garment are referred to herein as panels or fabric panels. The fabrics that form the body of the garment can be single or multi-ply. Assembly of fabric panels into garments is well known and not described herein. As used herein, a ply is a layer of fabric. Multi-ply garments are formed by attaching panels (e.g. torso panels, side panels, etc.) to the body fabric. The body fabric and, optionally, additional fabric panels are assembled together to form the garment. In certain embodiments, the body of the garment has one or more support panels attached thereto or affixed thereon for additional support, shaping, comfort, etc. The use of support panels to enhance the features of shapewear garments is well known to one skilled in the art.

The garment described herein includes a body fabric with, in certain embodiments, one or more fabric support panels attached to the body fabric. The body fabric itself may be formed from one, two or more body fabric panels. The support panel(s) enhance, supplement, and/or complement the shaping, control and smoothing provided by the body fabric to the wearer. In one embodiment, the body fabric is a front body fabric and a back body fabric sewn together. In a further embodiment, the inside of the back body fabric (i.e., the side facing the wearer) has a support panel fabric attached thereto. The back body fabric has a plurality of stays in fixed association with the back fabric support panel. The stays can be carried by either the body fabric or the back fabric support panel. The stays are typically disposed in casings, the casings being affixed to the body fabric. In one embodiment, the support panel affixed to the back body fabric has a plurality of the casings. The casings receive filler material in addition to the stay. The filler material provides additional cushion between the stay and wearer, adding to the comfort of the wearer of the garment.

The casings with the stays disposed therein are placed in association with the body fabric such that, when the garment is worn, the stays are located in the flat of the back region of the wearer. The stays may be affixed to either the support panel or the back body fabric prior to garment assembly. Thus, embodiments of the garments described herein include stays affixed to the body fabric in the back of the garment. In certain embodiments, the stays are positioned such that the stays are retained in the flat region of the wearer's back (i.e., the region at and above the waist) when the garment is worn. In other embodiments, the stays are placed so that the stays extend from about the waist of the wearer downward. In these embodiments, the stays are proximate to the lower region of the wearer's back when the garment is worn. In those embodiments where the garment includes support panels, the stays may be disposed between the support panel and the body fabric and carried either by the support panel or the body fabric. There are no stays located in the front of the garment. Nor are the stays positioned such that they would be disposed on the side of the wearer when the garment is worn.

For example, in the embodiments of the present invention where the garment is formed from a body fabric on which support panels are placed in discrete locations for additional support, the garment stays are positioned only at the back of the garment. No stays are placed on the front of the garment. Also, in certain embodiments the stays are disposed in pairs, each member of a pair spaced approximately equidistant from what will be the location of the wearer's spine when the garment is worn. However, other stay placements that do not require equidistant pairs are contemplated. In one embodiment, there are two pairs of stays. One pair is an inner pair and one pair is an outer pair. In another embodiment there is only one pair of stays in the garment. In other embodiments there can be an odd number of stays (i.e. three or even five). In these embodiments the middle stay is placed equidistant from the stays placed on either side of it. There are at least two stays. There is no required number of stays, so long as the stays are in the location of the back of the garment specified herein and limited to that location. The maximum number of stays is limited by practical considerations such as the size of the garment and the comfort of the wearer. In preferred embodiments, stays number at least two and do not exceed five.

In certain of the embodiments, the garment is provided with silicone to assist in preventing the garment from rolling over or riding down or otherwise shifting when the garment is worn. Such a feature is described in commonly owned U.S. Provisional Application No. 61/886,166 filed on Oct. 3, 2013 and entitled "Shapewear Garment With Gripping Silicone That Resists Rollover," the disclosure of which is incorporated by reference herein. Placement of the silicone will depend on the garment configuration. Garments are described herein as waistline garments (garments that extend from the waist and below), high waist garments (garments that extend above and also below the waist) and bras. In certain embodiments, such as camisoles, brassieres, etc. that are worn in the region from the upper torso to about the waist of the wearer, the silicone is placed near the lower opening (i.e. the opening of the garment more proximate to the waist) of the garment (i.e. the lower portion of the garment). In high waist garments, the silicone can be placed at the leg openings. In such garments, the leg openings can be at the top of the thigh or further down on the leg. In certain garments, silicone can be placed near the upper portion of the garment.

Although applicants do not wish to be held to a particular theory, applicants believe that, by positioning the stays exclusively at the back of the garment, the garment imparts shape and control to the wearer. It is believed that the stays, being confined to the back region of the wearer when the garment is worn, both anchor the garment on the wearer and provide an unprecedented level of comfort and stability to the garment. The present invention provides particular advantages when the garment is strapless (e.g. strapless brassieres, camisoles, body briefers, etc.).

Further advantages will be realized by various aspects of the invention and will be apparent from the following detailed description.

BRIEF DESCRIPTION OF THE DRAWINGS

The invention will be better understood from the Detailed Description of the Preferred Embodiments and from the appended drawings, which are meant to illustrate and not to limit the invention, and wherein:

FIGS. 3A-3C depict a high waist brief garment according to an embodiment of the invention;

DETAILED DESCRIPTION

Figure 1C:
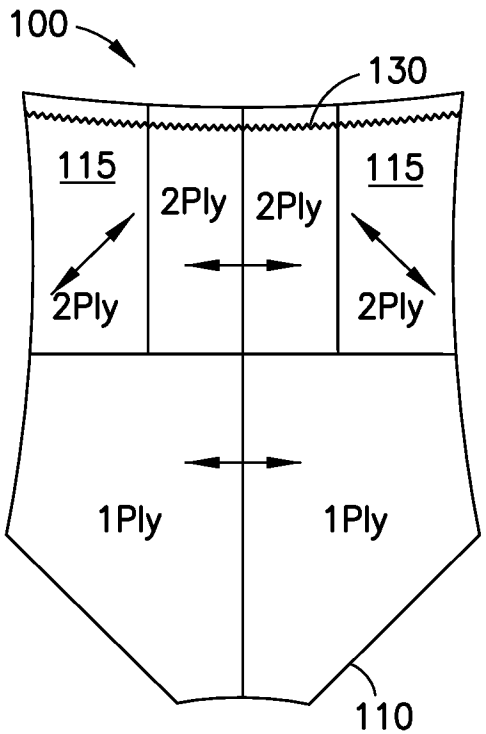
FIGS. 1A-1C show a high waist brief garment according to one embodiment of the invention.

Referring to the drawings, like reference characters refer to similar parts. The current application will be described with respect to an array of garments including, but not limited to, high-waisted shapewear garments, brassieres (both strapped and strapless), waistline garments (garments worn at the abdomen that are not "highwaist" in that they do not extend above the wearer's waist) and camisoles (strapped and strapless). However, one of ordinary skill in the art will recognize that the features of the current invention are equally applicable to other types of foundation garments, such as body briefers, body suits, cinchers, torsettes, and long leg garments. The present invention can also be used in non-foundation garments (e.g. activewear garments such as swimsuits). The present invention provides particular advantages when used in strapless garments.

Figure 1B:
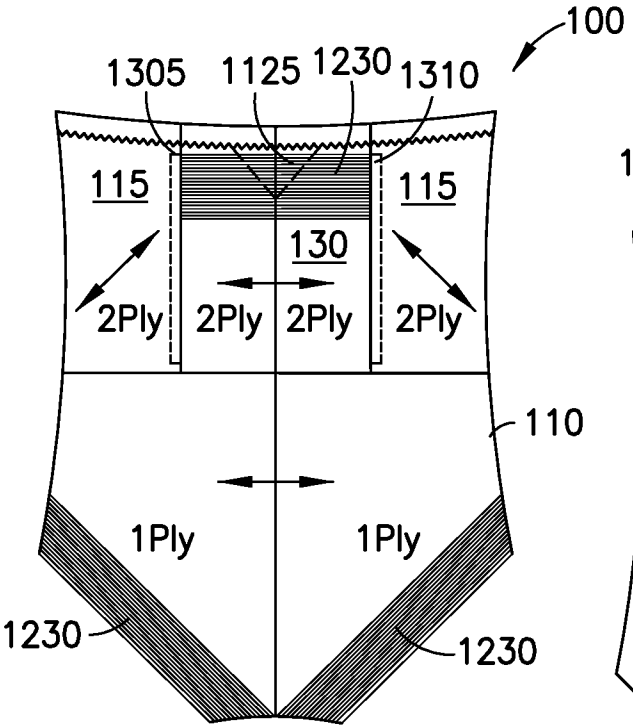
Figure 1A:
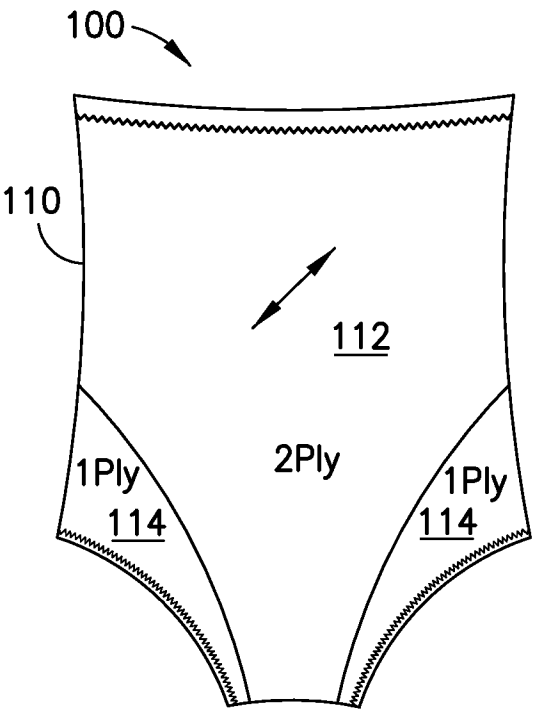

Referring to FIGS. 1A-1C, a high-waisted shapewear garment 100 is shown. The high-waisted shapewear garment includes a body fabric 110, on which a wrap panel 112 and a support panel 130 have been placed. The body fabric 110 may be formed from one, two, or more fabric panels sewn together to create the body of the garment.

FIG. 1A shows the front, exterior surface of the garment 100. According to the embodiment shown in FIG. 1A, the body fabric 110 in the front of the garment includes a wrap panel 112 attached to the inside of body fabric 110. According to this embodiment, the wrap panel 112 is cut on the bias to better conform to the wearer's shape. As shown in FIG. 1B, the wrap panel 112 wraps around the wearer's torso to shape and smooth the midsection of the wearer.

The wrap panel 112 does not cover the entirety of body fabric 110. In the embodiment shown, the wrap panel 112 does not occupy hip locations 114. However, wrap panel may not occupy other areas, such as a V-shaped area (not shown) on the front of the body fabric, near the top. The hip locations 114 and the V-shaped area are only the body fabric 110 with no support panels disposed thereon. That is, the hip locations 114 and V-shaped area are only the body fabric material. By not including the wrap panel 112 in the hip locations 114 and the V-shaped area, additional elasticity is provided that provides added comfort to the wearer.

By placing the wrap panel 112 on the body 110, a two-ply section of garment 100 is created. While this portion of the garment is described as two-ply in this example, this is for purposes of illustration. The skilled person will appreciate that the "ply" (i.e. layers of fabric) in any garment is a matter of design choice. For example, the garment body can be one-ply, two-ply, etc. Similarly, a panel can be one-ply, two-ply, etc. The sections of the garment that have both the body fabric 110 and the wrap panel 112 have more shape and control than the areas comprising just the body fabric 110 (e.g., hip locations 114, and the illustrate V-shaped area). In this regard, the body fabric 110 provides a degree of control to shape and smooth specific areas. The use of wrap panel 112, and additional panels, gives more control to the shaping and smoothing of specific areas. In the embodiment shown in FIG. 1, the torso panel 112 provides more shaping and smoothing to the stomach, side, and back of the wearer. The placement of additional fabric panels will be readily apparent to those skilled in the art from the embodiments described herein.

In this regard, hip locations 114 allow for greater flexibility around the hip joint, thereby providing more comfort when the wearer walks, sits, or bends over. FIG. 1A shows hip locations 114 as single-ply fabric that is stretchable in both directions. In this regard, the hip locations 114 stretch more than where the wrap panel 112 is located.

Likewise, the wrap panel 112 has a V-shaped opening to form the V-shaped area 1125 on the body fabric 110. In this regard, the V-shaped area 1125 is only the body fabric 110 with no panel disposed thereon. The V-shaped area 1125 allows garment 100 to stretch more than the areas where the wrap panel 112 is located, thereby releasing tension and providing greater comfort.

One of ordinary skill would recognize that additional panels may be placed on body fabric 110 to create a garment with three-ply sections for even more support. Moreover, the wrap panel 112, and any additionally added panels, may have elasticity that varies by direction (e.g. one degree of elasticity horizontally and another degree of elasticity vertically). In certain embodiments, the degree of elasticity in one direction can be zero.

As noted above, wrap panel 112 is selected based on its ability to shape and smooth the wearer's stomach area. In this regard, elasticity (i.e. the ability of a fabric to stretch in response to tension and relax when tension is removed), direction of stretch, firmness, and softness are just several of the factors considered when deciding on the type of fabric used for wrap panel 112.

The body fabric 110 is selected based upon its appearance, elasticity, direction of stretch, firmness, and softness. In this regard, body fabric 110 may have elasticity in both the horizontal and vertical directions. However, one of ordinary skill in the art would appreciate that elasticity may be greater in one direction than it is in the other. One skilled in the art is able to select suitable fabrics for the garments described herein. Such fabrics are well-known and not described in detail herein.

FIG. 1B illustrates an interior surface (i.e. the garment is illustrated inside out) of the back of the body fabric 110, and FIG. 1C illustrates the exterior surface of the back of the body fabric 110. The garment has panels in discrete regions. The body panel 112 (FIG. 1A) and the support panel 130 are affixed to the interior surface of the back of body fabric 110. In this regard, another panel 115 is attached to the body fabric 110 such that panels 112 (FIG. 1A) and 115 circumscribe the wearer's midsection and provides shaping and smoothing in this region. The support panel 130 is also attached to the body fabric 110 and is adjacent the edges of the panel 115.

Additionally, FIG. 1B shows that body fabric 110 includes silicone 1230 disposed on the body fabric 110 to keep the garment stable on the wearer. Such silicone features are described in U.S. Pat. Nos. 7,228,809, 8,176,864 and 8,215,251, which are commonly assigned and incorporated by reference herein. The silicone feature 1230 is disposed on the body fabric 110 adjacent the leg openings. The silicone feature is illustrated as a series of silicone polymer beads, the widest of which is nearest the edge of the body fabric 110. However, although a series of silicone polymer beads is illustrated, embodiments with only a single bead are contemplated. Moreover, one of ordinary skill in the art would recognize that the silicone feature is not required to finish the edge of the garment (i.e., keep the body fabric from unraveling, tearing, etc.). In this regard, any known method of forming a finished edge adjacent the leg openings could be used, including elastic, lace, etc.

FIG. 1B also shows support panel 130 affixed to the body fabric 110 and the edges of the panel 115, such that it forms a mostly two-ply section of garment 100. An exception is the V-shaped area 1125, which is a single-ply section of body fabric 110 that permits for more stretch and will relieve tension in the garment when worn.

In embodiments of the present invention, the fabric is cut on the bias (indicated by a diagonal arrow) to provide more shaping and control to the wearer. Cutting fabric on the bias is well known to persons of ordinary skill and not described further herein.

The support panel 130 has a first casing 1305 and a second casing 1310 to receive what is referred to herein as stays. Those skilled in the art will often use the alternate terms "bones" or "ribs." In the embodiment shown in FIG. 1B, the first casing 1305 and the second casing 1310 each include filler material and a single stay. After the filler material and stays are placed in the first and second casings, the casings are sealed (e.g. sewn closed or closed using an adhesive). The support panel 130, with the sealed casings, is then attached to the body fabric 110 and the edges of wrap panel 112 to complete the back of the garment 100. A cured polymer feature, 1330, e.g., a plurality of polymer beads as discussed above, may be placed on the support panel 130 between the two stays.

Preferably, the stays (bones) used in the first and second casings are metal spiral stays. Such stays are commercially available. One such stay is ACM1-0600 sold by Higgins Supply Co., Inc. The tips of the metal spiral stays are coated in a polymer material to prevent poking or stabbing the wearer. In alternative embodiments, other types of stays may be used. For instance, zig-zag stays may be used instead of the spiral stays or plastic can be used instead of metal stays. Such stays are also commercially available. One such stay is a plastic six inch stay (Model No. FN37) from Lacis. The use of fabric stays or busks may be used in place of the stays described herein in certain embodiments. Additionally, the stays are all approximately the same length. In the embodiments where the garment is a highwaist garment or bra or camisole, the stays do not extend beyond the wearer's lower back. By contrast if the garment is worn in the area of the abdomen and does not extend above the waist, the stays are disposed in the area of the lower back and do not extend upward beyond the waistline.

In this regard, the stays are about 1 inch to about 7 inches in length. The above stays are by way of example. For garments where the top the garments rests at the waistline of the wearer covers the abdomen area and, the stays are about 2 to about 4 inches in length. In those embodiments of the present invention where the garment is configured as a brassiere, the stays are about 1 inch to about 7 inches in length. In those embodiments where the garments extend from the waist and above and cover the wearer's torso, the length of the stays are about 4 inches to about 7 inches. In garments that extend over the torso of the wearer (i.e. from the thigh region to the upper back region) the stays are preferably about 4 inches to about 7 inches in length. Stays of different materials (e.g. fabric) and configurations are contemplated.

In the preferred embodiment shown in FIG. 1B, the illustrated pair of stays are located on either side of the wearer's spine and the center seam of the body fabric 110 such that they lie on the flat of the wearer's back. For all embodiments described herein, it is important to note that the stays, located on the flat of the wearer's back, act as anchors and pull the front of the body fabric 110 and the front panel 112 (FIG. 1A) back to flatten, smooth, and, otherwise, control the wearer's midsection, stomach, sides and back. Moreover, the stays provide stability to the garment. The second silicone feature 1230 helps to keep the stays in place on the small of the wearer's back.

Furthermore, placing stays in or on the front of garment 100 appears to counteract the effect of having the stays only in the back of the garment. In this regard, stays in the front of the garment 100 have been shown to reduce, or even negate, the anchoring and pulling effect achieved by only having the stays on the back of the garment 100. Additionally, placing stays in the front of body fabric 110 decreases the comfort of the garment since they would poke the wearer when sitting down or bending over. Thus, stays on the front of body fabric 110 appear to adversely affect the form, fit, and function of the garments described herein.

Figure 2C:
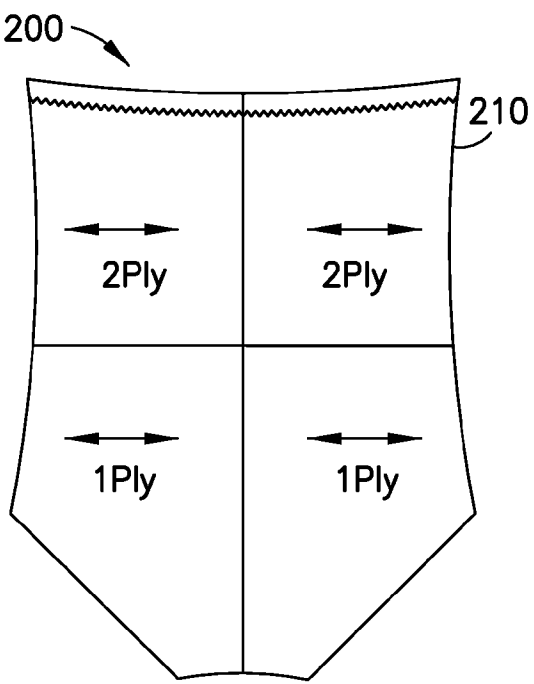
FIGS. 2A-2C illustrate a high waist brief garment according to another embodiment of the invention.
Figure 2B:
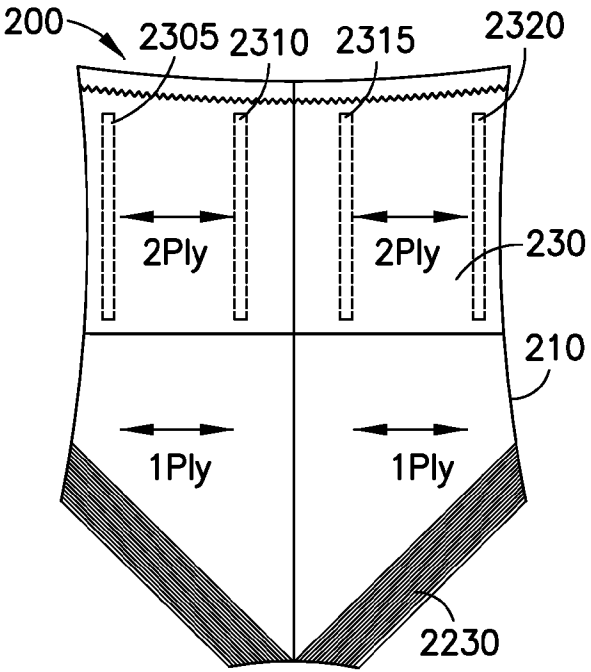
Figure 2A:
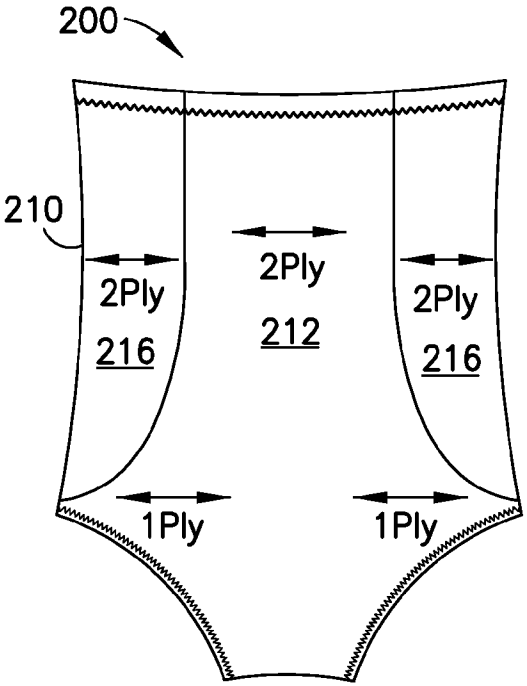

Referring to FIGS. 2A-2C, an undergarment 200 according to a second embodiment is shown. The garment of FIGS. 2A-2C is illustrated as a high waist garment. Like undergarment 100, the undergarment 200 has a body fabric 210, to which a torso panel 212, side panels 216, and a support panel 230 are affixed.

FIG. 2A illustrates the exterior front surface of the body fabric 210. According to this embodiment, a torso panel 212 and side panels 216 are attached to the inside of the front of body fabric 210. That is, the torso panel 212 and the side panels 216 are attached to the body fabric 210 to provide smoothing and shaping to targeted areas. The torso panel 212 and the side panels 216 form a two-ply section of garment 200.

In this regard, the torso panel 212 and side panels 216 are selected based on their ability to shape and smooth the wearer's stomach and oblique areas. Elasticity, direction of stretch, firmness, and softness are just several of the factors considered when selecting the fabric for the torso panel 212 and side panels 216. According to this embodiment, the torso panel 212 and side panels 216 are selected to reduce the overall elasticity of body fabric 210.

Referring to FIGS. 2B-2C, the back of body fabric 210 is shown. Specifically, FIG. 2B shows the inside of the garment 200, while FIG. 2C shows the exterior of the back of garment 200. Similar to the body fabric panel 110 discussed with respect to FIG. 1B, the body fabric 210 has a silicone feature 2230 adjacent the leg openings in the back body fabric 210 to resist ride-up of the garment when worn. Although this embodiment is shown with a silicone feature, one of ordinary skill in the art would recognize that any finished edge could be used in place of the silicone feature 2230.

FIG. 2B shows the support panel 230 attached directly to the body fabric 210 to form a two-ply section of the garment that extends from side seam to side seam. Further, support panel 230 is attached to the body fabric 210 after the stays are sealed in casings 2305, 2310, 2315, and 2320. In this regard, the top edge of the support panel 230 aligns with the top edge of the body fabric 210 and the lower edge of the support panel 230 is above the wearer's buttocks. Thus, the support panel 230 creates a two-ply garment 200 on the upper half of the back of body fabric 210.

As with the casings discussed with respect to FIG. 1B, casings 2305, 2310, 2315, and 2320 each have filler material and stays placed in each one before being sealed. The stays can be selected from the stays discussed previously, such as metal spiral stays, zigzag stays, or any variety of plastic shaped stays. Filler material can be any type of known padding material, such as a polyester foam or cotton.

In the embodiments of the present invention that use two pairs of stays (i.e. 4 stays total) a silicone feature near the waist portion of the garment 200 is not required to resist rollover or riding down of the garment at the waist. That is, four stays provide support and keep the garment from shifting downward when worn. Further, the inner pair of stays, located in casings 2310 and 2315, are positioned on the flat of the wearer's back, preferably above the wearer's tailbone. The outer pair of stays, located in casings 2305 and 2320, are also located on the flat of the wearer's back, preferably above the wearer's hip bones. As used herein, the wearer's back does not include the side portions of the wearer's body. With reference to the plane of the wearer's waist, and defining the waist as a circle bisected by a line drawn extending from one side of the wearer to the other, the stays are confined to the portion of the circle behind the line. In preferred embodiments, the stays are confined to only a portion of the semicircle, that portion being within approximately 60 degrees on either side of the wearer's spine (which is at about 0 degrees for purposes of this illustrative example).

Referring to FIGS. 3A-3C, another embodiment of a high waist undergarment 300 is shown. Like the previous two embodiments, garment 300 includes a body fabric 310. According to this embodiment the front of body fabric 310 has a torso panel 312 and two side panels 316 attached thereto. A support panel 330 and an upper back fabric panel 326 are attached to the back of body fabric 310.

The torso panel 312 is a fabric panel that is attached to body fabric 310. In this regard, the torso panel 312 is selected for its ability to shape and smooth the wearer's torso region. In this regard, the torso panel 312 forms a two-ply section of garment 300. However, one of ordinary skill in the art would recognize that additional panels may be added to torso panel 312 to create three-ply sections of garment 300. The torso panel 312 may also have elasticity in multiple directions (e.g. both horizontally and vertically) or greater elasticity in one direction than the other direction. Moreover, the torso panel 312 has a V-shaped opening (not shown) such that when it is attached to body fabric 310 it leaves a one-ply section of body fabric 310 to allow for additional stretch of garment 300.

The side panels 316 are attached to body fabric 310 to form three-ply area of garment 300. This allows the undergarment 300 to provide more control and smoothing to the oblique region of the wearer, thereby providing more of an hour-glass shape. In some embodiments the side panels 316 are a different fabric from the body fabric 310, but it is not required to be different. In this regard, a firmer, less elastic material may be used in the side panels 316 to provide more shaping and smoothing.

Turning to FIG. 3B, the interior of the back of body fabric 310 is shown. FIG. 3C, shows the exterior of the back of body fabric 310. As noted above, the upper back fabric panels 326 and the support panel 330 are affixed to interior of the body fabric 310 to form a two-ply section of the back of garment 300.

The upper back fabric panels 326 may be the same material used for the torso panel 312. In this regard, the upper back fabric panels 326 perform similar, if not the same, functions as the torso panel 312 as far as shaping and smoothing the wearer's midsection. However, one of ordinary skill in the art will appreciate that the upper back fabric panel 326 does not necessarily have to be the same material as the torso panel 312. In this regard, a firmer, less elastic fabric may be chosen. Additionally, the upper back fabric panel 326 may only have elasticity in one direction or greater elasticity in one direction than the other.

FIG. 3B also shows the support panel 330 attached to the body fabric 310 between the upper back fabric panels 326 to create a two-ply area of garment 300. A V-shaped cut-out is shown near the top of the support panel 330. This V-shaped cut-out forms a single-ply, V-shaped area 3325 on the back of garment 300 to allow for additional stretch.

According to this embodiment, the support panel 330 has a first casing 3305 and a second casing 3310 to receive stays along the seam where the support panel 330 meets the upper back fabric panels 326. In this regard, the stays sit on the outside of the seam on the back fabric panels 326. There is only one pair of stays in this garment configuration.

As previously discussed, the first casing 3305 and the second casing 3310 each include filler material and a stay sealed into each casing. The stays lying on the upper back fabric panels 326 are positioned on the flat of the wearer's back. Additionally, a second silicone feature function 3330 is formed on the support panel 330 between the first casing 3305 and the second casing 3310.

The stays are located on the body fabric 310 such that they lie on the flat of the wearer's back on either side of the wearer's spine when the garment is worn. Having the stays in this location allows them to behave as anchors and pull the front of body fabric 310 back to flatten, smooth, and, otherwise, control the wearer's sides, midsection, and stomach. Moreover, the stays, in combination with the second silicone feature 3330, help to provide stability to the garment to keep it in place and prevent it from rolling over, riding down, etc.

Additionally, the body fabric 310 according to this embodiment includes a first silicone feature 3230 adjacent the leg openings of the back of the body fabric 310. The first silicone feature 3230 may be a single polymer bead or a series of polymer beads of different widths, where the bead closest to the edge is wider than the remaining beads. However, one of ordinary skill in the art would appreciate that any known technique for finishing the edge of the garment 300 could be used.

Figure 4C:
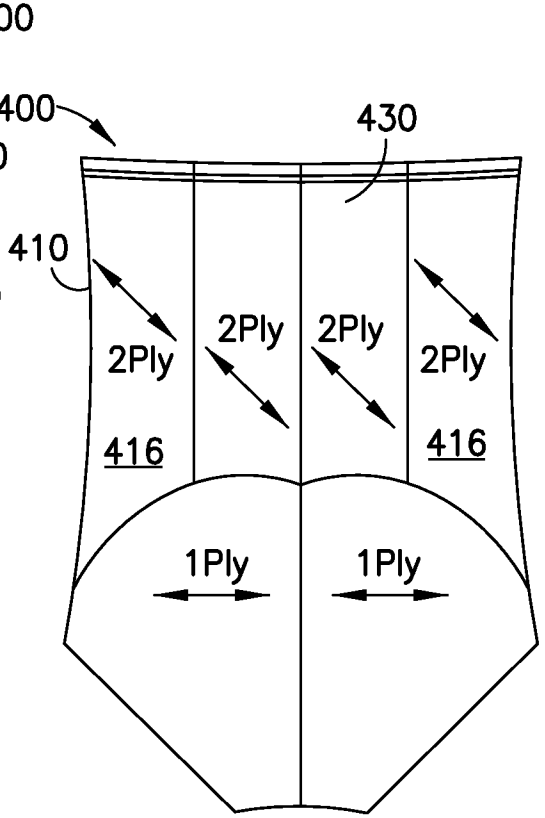
FIGS. 4A-4C show a high waist brief garment according to one embodiment of the current invention.
Figure 4B:
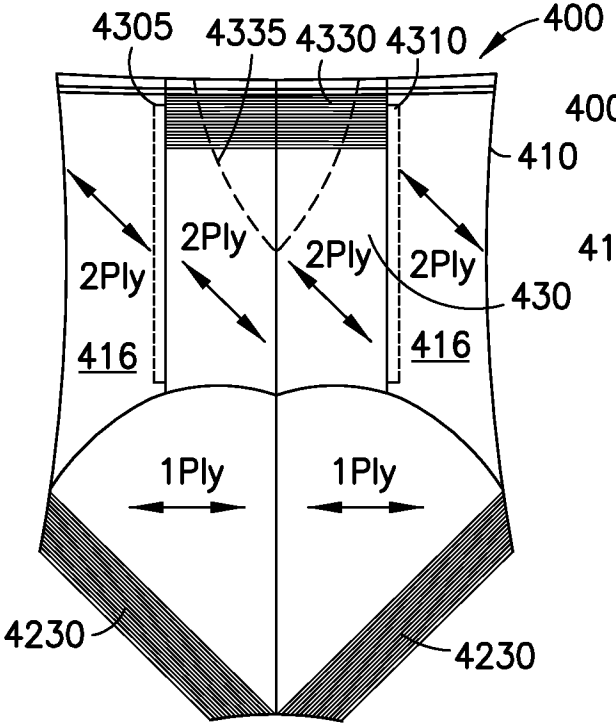
Figure 4A:
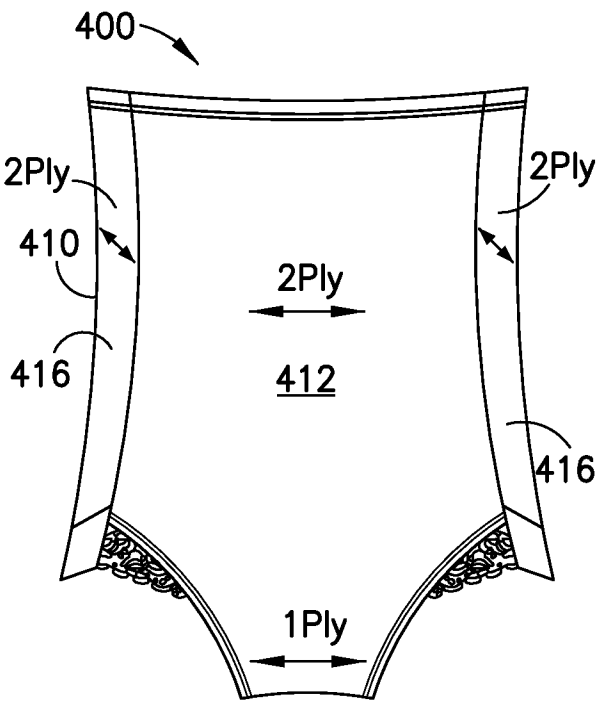

Referring to FIGS. 4A-4C, a high-waisted foundation garment 400 is shown. The high-waisted foundation garment 400 includes a body fabric 410. The body fabric 410 has a torso panel 412, side panels 416, and a support panel 430 attached thereto.

FIG. 4A shows the front exterior surface of garment 400. According to this embodiment, the torso panel 412 and side panels 416 are attached to the inside of body fabric 410.

The torso panel 412 is attached to body fabric 410 to form a two-ply section of garment 400. The torso panel 412 is a fabric selected for its ability to shape and smooth the wearer's midsection. In this regard, the torso panel may have elasticity in a single direction or greater elasticity in one direction than the other. Moreover, one of ordinary skill would recognize that the torso panel 412 may be a two-ply fabric so as to create a three-ply section of garment 400.

As with previously discussed embodiments, the torso panel 412 also has a U-shaped cut-out such that when the torso panel 412 is attached to the body fabric 410, a single-ply, U-shaped area is formed on the garment 400 to provide additional stretch.

The side panels 416 are affixed to the interior of body fabric 410 to form a different two-ply area of garment 400. The side panels wrap around the wearer and are connected to the body fabric 410 that makes up the back of garment 400. In this regard, side panels 416 allow for more shape and control to the wearer's sides and back. Moreover, one of ordinary skill in the art will recognize that the side panels 416 may have elasticity in only a single direction (e.g. horizontally or vertically) or greater elasticity in one direction.

Turning to FIGS. 4B and 4C, an interior surface of the back of garment 400 is illustrated in FIG. 4B and the exterior surface of the back of garment 400 is shown in FIG. 4C. According to this embodiment, the side panels 416 and a support panel 430 are attached to the body fabric 410.

The support panel 430 is similar to previously discussed embodiments, with the exception that that stays are located on the side panels 416. In this regard, the support panel 430 has a V-shaped cut-out. When the support panel 430 is attached to the body fabric, V-shaped area 4335 in the panel provides the garment 400 with additional stretch.

The side panels 416 and the support panel 430 may be attached to body fabric 410 in such a way that the seams help to shape and smooth the wearer's buttocks. Additionally, the body fabric panel 410 includes a first silicone feature 4230 near the leg openings of the back body fabric, as previously discussed.

FIG. 4B shows that the side panels 416 wrap around the wearer's midsection. Moreover, a place for the support panel 430 is provided on body fabric 410 between the edges of the side panels 416. In this embodiment, the side panels 416 include a first casing 4305 and a second casing 4310 along the seam where the support panel 430 meets the side panels 416. As with previously discussed embodiments, filler material and a stay is placed in each of the casings 4305 and 4310 and are sealed into place. The support panel 430 is attached to the side panels 416 such that support panel 430 overlaps the casings 4305 and 4310. Finally, a second silicone feature 4330 is formed on the support panel 430 between the first casing 4305 and the second casing 4310.

Locating the stays in this manner allows them to behave as anchors and pull the front of garment 400 back to flatten, smooth, and, otherwise, control the wearer's sides, midsection, and stomach. Moreover, the stays, in combination with the second silicone feature 4330, help to provide stability to the garment to keep it in place and prevent it from rolling over.

Figure 5C:
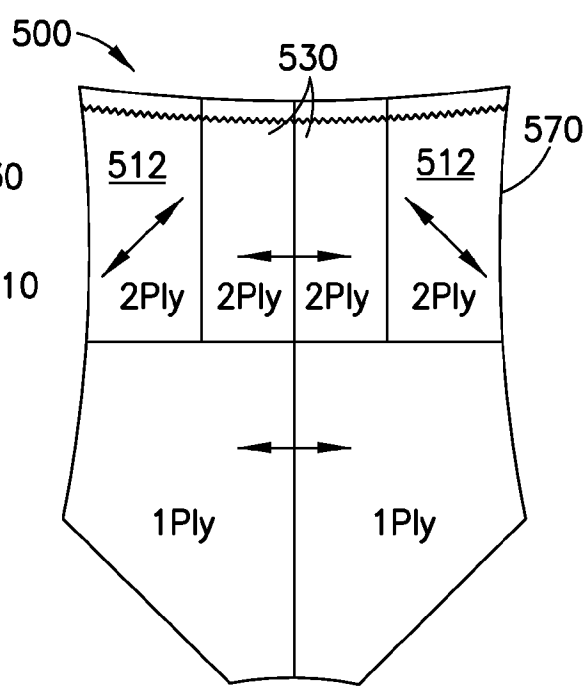
FIGS. 5A-5C show a high waist brief garment according to an embodiment of the invention.
Figure 5B:
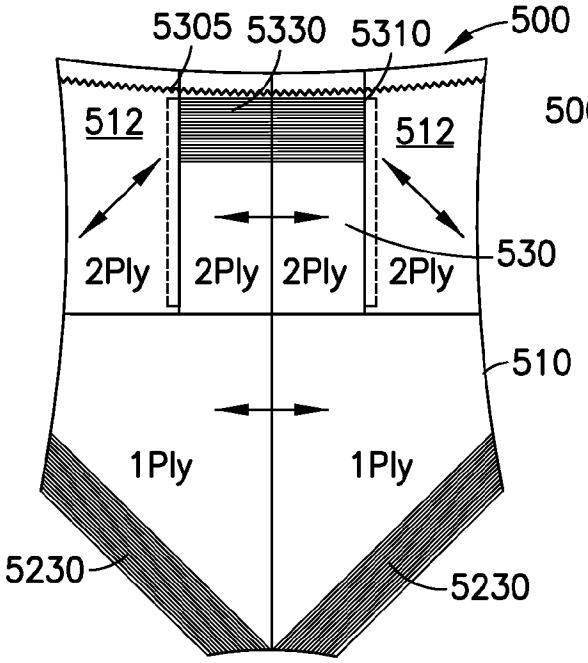
Figure 5A:
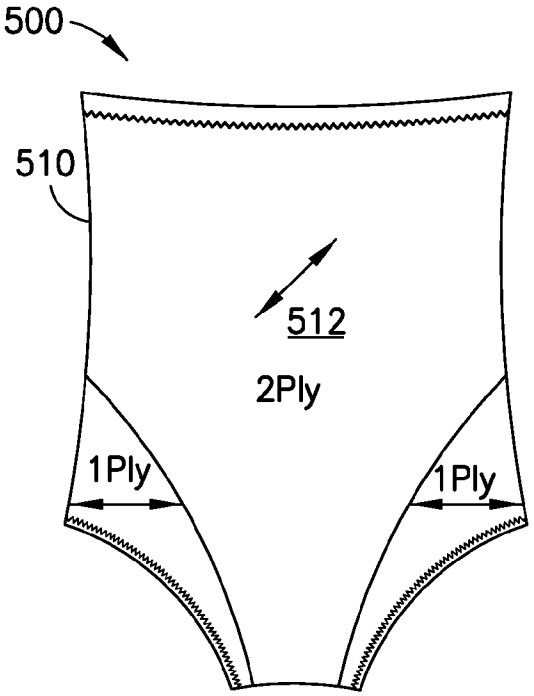

Turning to FIGS. 5A-5C, a high-waisted shapewear garment 500 similar to the shapewear garment 100 is shown. In this regard, a body fabric 510 has a torso panel 512 and a support panel 530 attached thereto.

As discussed above with respect to FIG. 1A, FIG. 5A shows the front, exterior surface of body fabric 510. According to the embodiment shown in FIG. 5A, a torso panel 512 is attached to the interior of the body fabric 510. The torso panel 512 is cut on the bias to better conform to the wearer's shape and wraps around to the back of body fabric 510.

According to the embodiment illustrated in FIG. 5A, the torso panel 512 is attached to the body fabric 510 to form a two-ply section of garment 500 with elasticity in both the horizontal and vertical directions, however any appropriate fabric panel may be used its place.

FIG. 5B illustrates a back, interior surface of body fabric 510, which includes the torso panel 512 and the support panel 530. FIG. 5C shows the back, exterior surface of body fabric 510.

In preferred embodiments, the torso panel 512 includes a first silicone feature 5230 adjacent each of the leg openings on the back portion of the body fabric 510. As discussed above, the first silicone feature 5230 may be formed of silicone or another suitable cured polymer. Such polymers are well known to those skilled in the art. The silicone feature 5230 can be provided for stability, to finish the edge of the body fabric 510, or both. In alternative embodiments, other known means can be used to finish the edge of body fabric 510.

FIGS. 5B and 5C also show the support panel 530 being attached to the body fabric 510 between sections of the torso panel 512. In this regard, the support panel 530 has a first casing 5305 and a second casing 5310 to receive stays or bones in one of the techniques previously discussed. Thus, the casings are sealed after the filler material and stays are placed therein. The support panel 530, with the sealed casings, is then attached to the body fabric 510. According to this embodiment, the stays can sit either on the outside seam such that they are carried by the torso panel 512 or on the inside seam such that they are carried by the support panel 530. Furthermore, a second silicone feature 5330 is then formed on the upper portion of the support panel 530.

The figures above illustrate implementing the invention on high-waisted foundation garments. However, one of ordinary skill would appreciate that the described embodiments apply equally to body briefers, body suits, brassieres (strapped and strapless) cinchers, torsettes, and long leg garments. Moreover, the inventive concept may be applied to camisoles as well. For instance, a back fabric panel of a camisole may have the one or two pairs of stays described in the embodiments above. In this regard, the stays would be on the small of the wearer's back. The camisole differs from the embodiments discussed above in that the silicone feature that prevents the garment from riding down or rolling over in the high-waisted garments is located at the bottom of the garment. This feature so placed helps keep the stays in place and prevents the camisole from riding-up. This feature, when deployed in a brassiere, also resists riding-up (which is a significant problem with brassieres). In the strapless brassiere garments, the back stays provide particular advantage, as they keep the garment in place and resist the pull of the garment downward.

Figure 6:
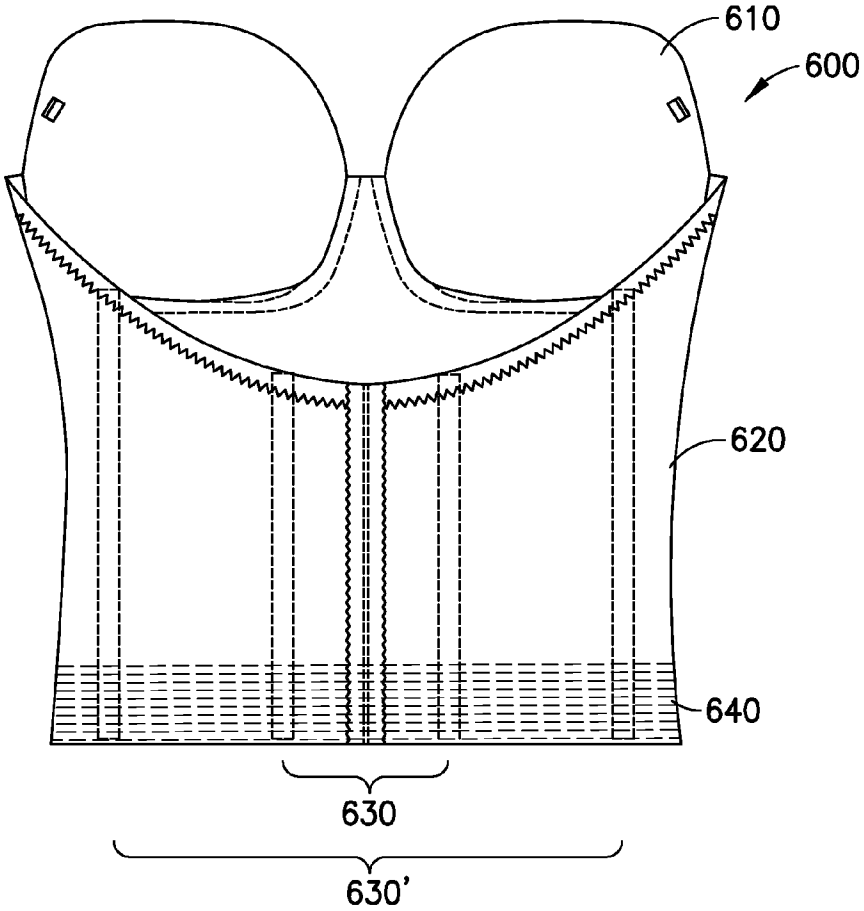
FIG. 6 illustrates an embodiment of the invention wherein the garment is configured as a strapless bra assembly with the bottom of the garment at the waist of the wearer.

One alternative garment configuration is illustrated in FIG. 6. The garment illustrated is a strapless bra garment 600 incorporating both a cup or bra portion 610 and a torso portion 620. The back view of the garment 600 is illustrated. There is disposed on the torso portion two pairs of bones 630, 630' each pair spaced roughly equidistant from the wearer's spine. Pair 630 is nested within pair 630'.

The torso portion has a gripper feature 640 disposed thereon near the lower portion of the garment that rests at the waist of the wearer. The silicon feature 640 prevents the bra garment 640 from riding up while the bones 630, 630' keep the bra garment 600 from slipping downward. The garment is configured to provide support to wearer through the midsection, so the garment fabric provides controlled stretch to provide support, smoothing and shape to the wearer. In some embodiments, the interior of the garment includes support panels (not illustrated) for extra support.

Figure 7:
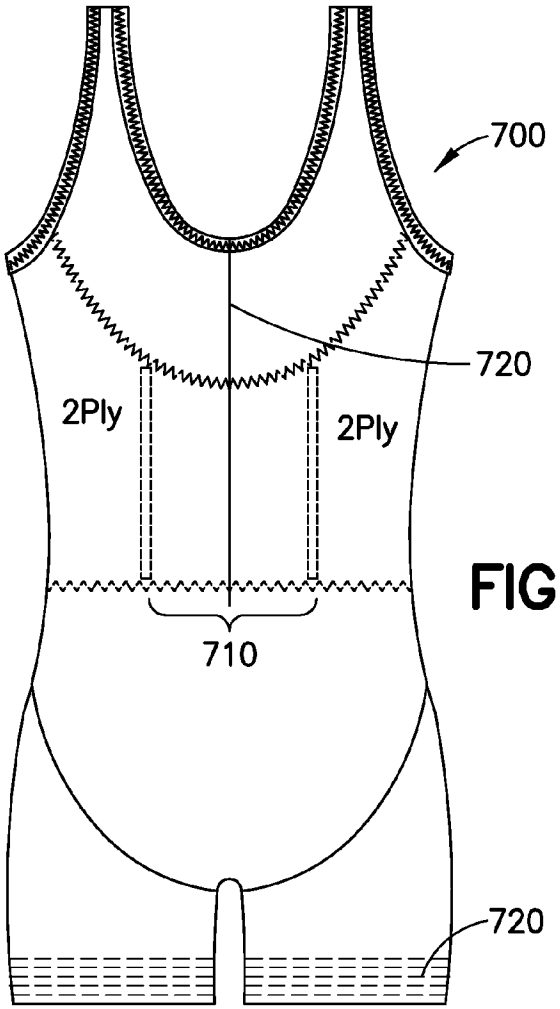
FIG. 7 illustrates an embodiment of the present invention wherein the high waist garment has straps and is configured to cover the majority of the wearer's torso (i.e., a long leg torsette), extending from the upper leg to the wearer's shoulders.

FIG. 7 illustrates another embodiment of the high waist garments of the present invention. The garment 700 covers the torso of the wearer from the upper leg to the chest. The garment 700 is depicted from the back where a pair of stays 710 are illustrated. The stays 710 are positioned roughly equidistant from the rear center 720 of the garment 700. The stays are positioned so that they extend near the wearer's waist to about the lower portion of the shoulder blade in the upper back of the wearer. The garment has a silicone feature 720 that surrounds the leg openings. The silicone feature prevents the garment from riding up on the wearer. As in other embodiments, there are no stays in the garment other than those that are illustrated.

Figure 8:
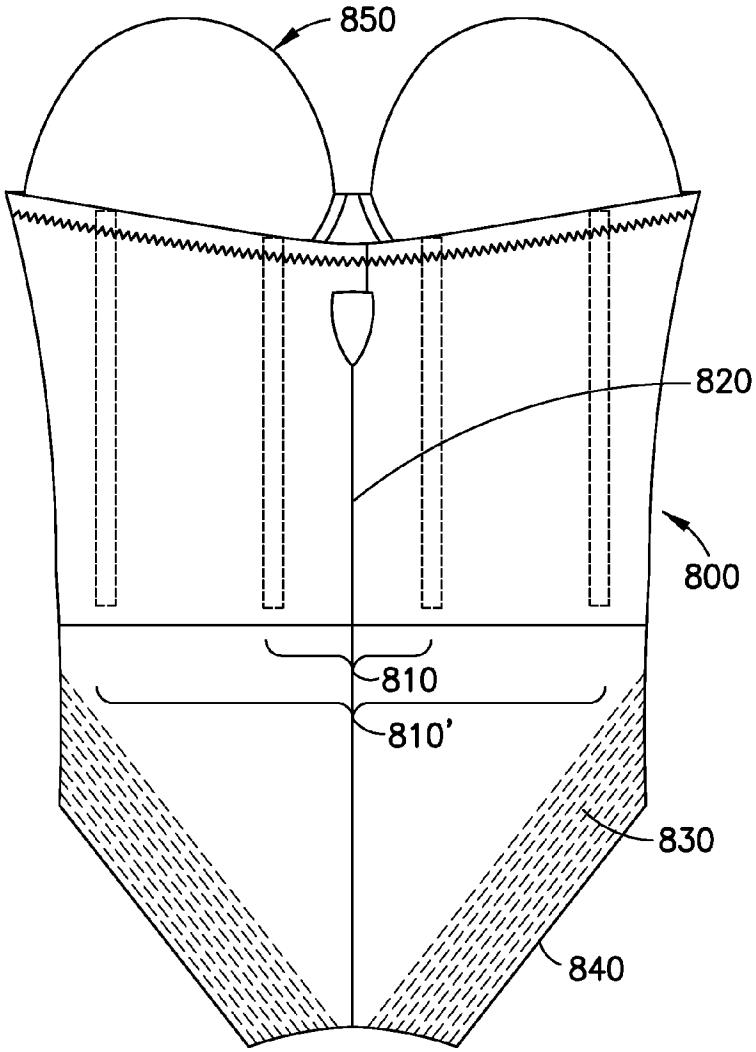
FIG. 8 illustrates an embodiment of the present invention wherein the garment extends from the upper thigh of the wearer to just beneath the shoulder and configures as a strapless body briefer.

FIG. 8 is a back view of another embodiment of the present invention. The garment 800 is a strapless body briefer that covers the torso of the wearer from approximately the upper thigh to the upper back. The garment has two pairs of stays 810 and 810', with pair 810 nested between pair 810'. The stays are positioned such that each stay in the pair is roughly equidistant from the middle back of the garment. The garment has a cup portion 850. The garment 800 has a silicone feature 830 at the leg opening 840, but only at the back of the leg opening to provide smoothing and shaping.

Figure 9:
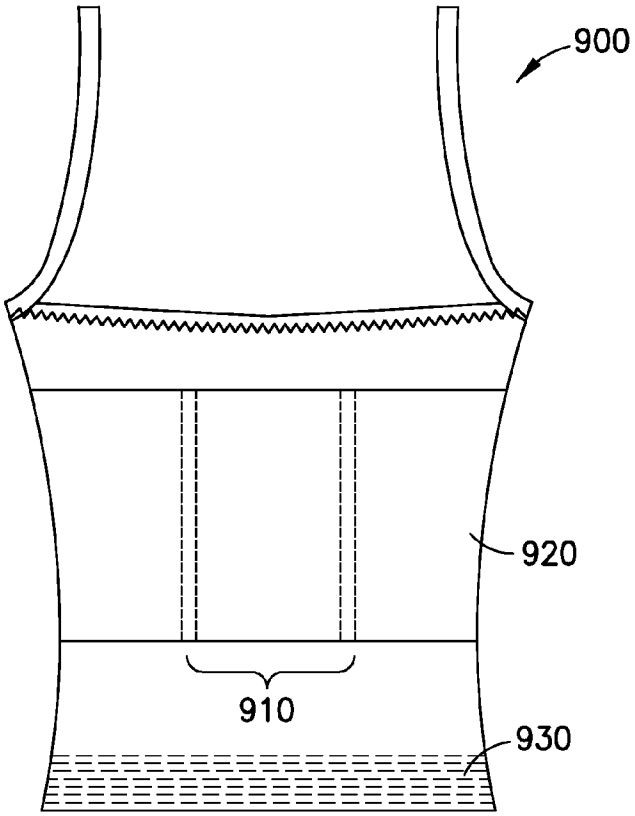
FIG. 9 illustrates an embodiment of the present invention where the garment is camisole.

FIG. 9 illustrates a camisole embodiment of the present invention. In this embodiment the camisole 900 has a pair of stays 910 that span from above the waist of the wearer to the shoulder area in the wearer's upper back. The garment has a support panel 920. The casings in which the stays 910 are disposed are between the body fabric for garment 900 and the support panel 920. The garment 900 has a silicone feature 930 positioned near the waist of the garment.

Figure 10:
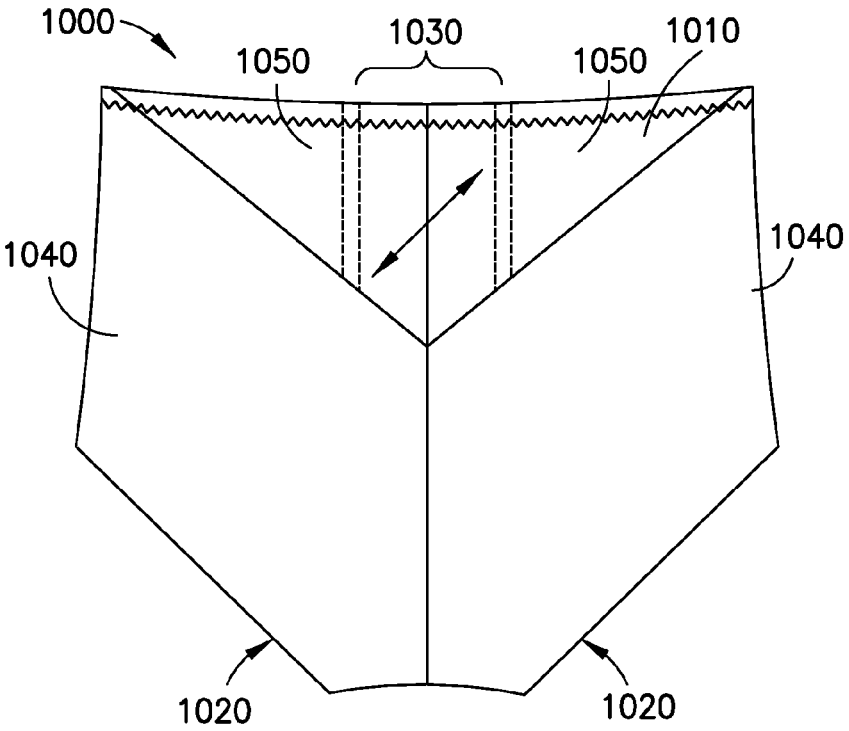
FIG. 10 is another embodiment of the present invention wherein the garment is a waistline garment.

FIG. 10 illustrates another embodiment of the invention where the garment is configured to fit on the abdomen. Referred to herein as a waistline garment 1000, the garment has a waistline opening 1010 and two leg openings 1020. The waistline garment has a pair of stays 1030 that extend from the waistline of the garment down over the lower back. The waistline garment 1000 is formed from fabric panels 1040 and 1050. Fabric panels 1050 are cut on the bias.

Figure 11:
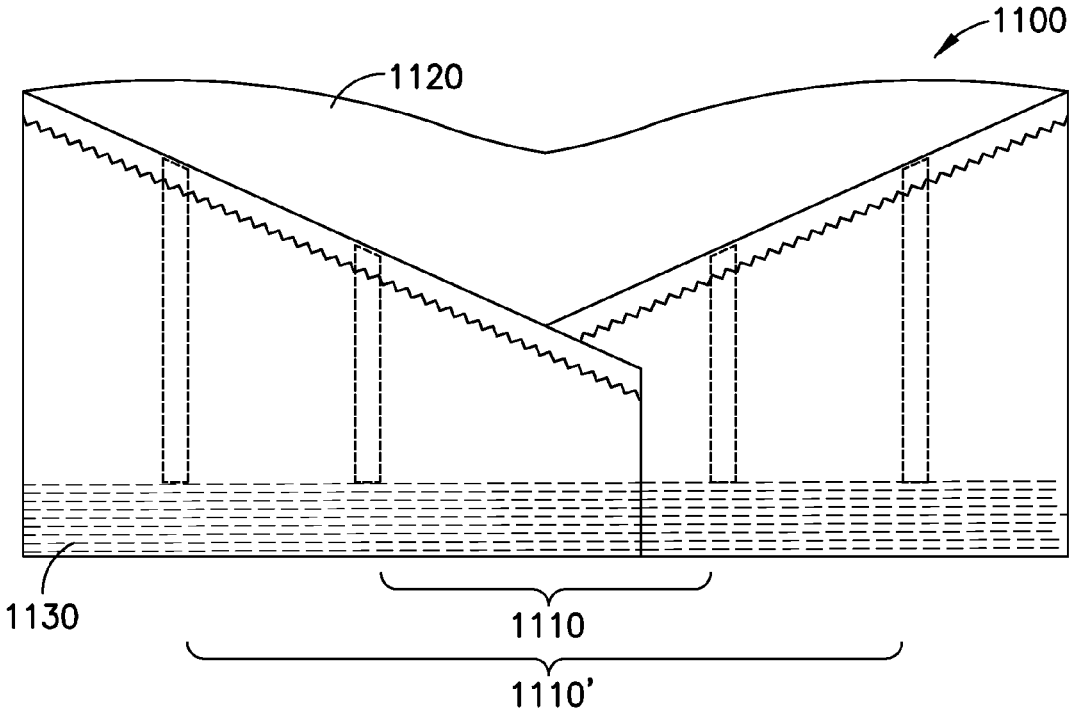
FIG. 11 is an embodiment of the present invention wherein the garment is configured as a strapless brassiere.

FIG. 11 is another garment embodiment of the present invention. The garment is a strapless bra. In this illustrated embodiment, there are two pairs of stays 1110 and 1110' disposed in casings as previously described herein. Two pairs of stays are not required. In this embodiment, the stays are of different lengths. Stays of different lengths are not required. Different stay lengths may be an adaptation for certain garment configurations. In this embodiment, the length of stays is about 1 inch to about 4 inches. As illustrated, the bra garment has a cup 1120 worn over the breast. Many bra configurations are contemplated and the contour shown is simply for illustration. The bra of FIG. 11 is illustrated with a silicone feature. The silicone feature 1130 keeps the garment stable when worn.

Figure 12:
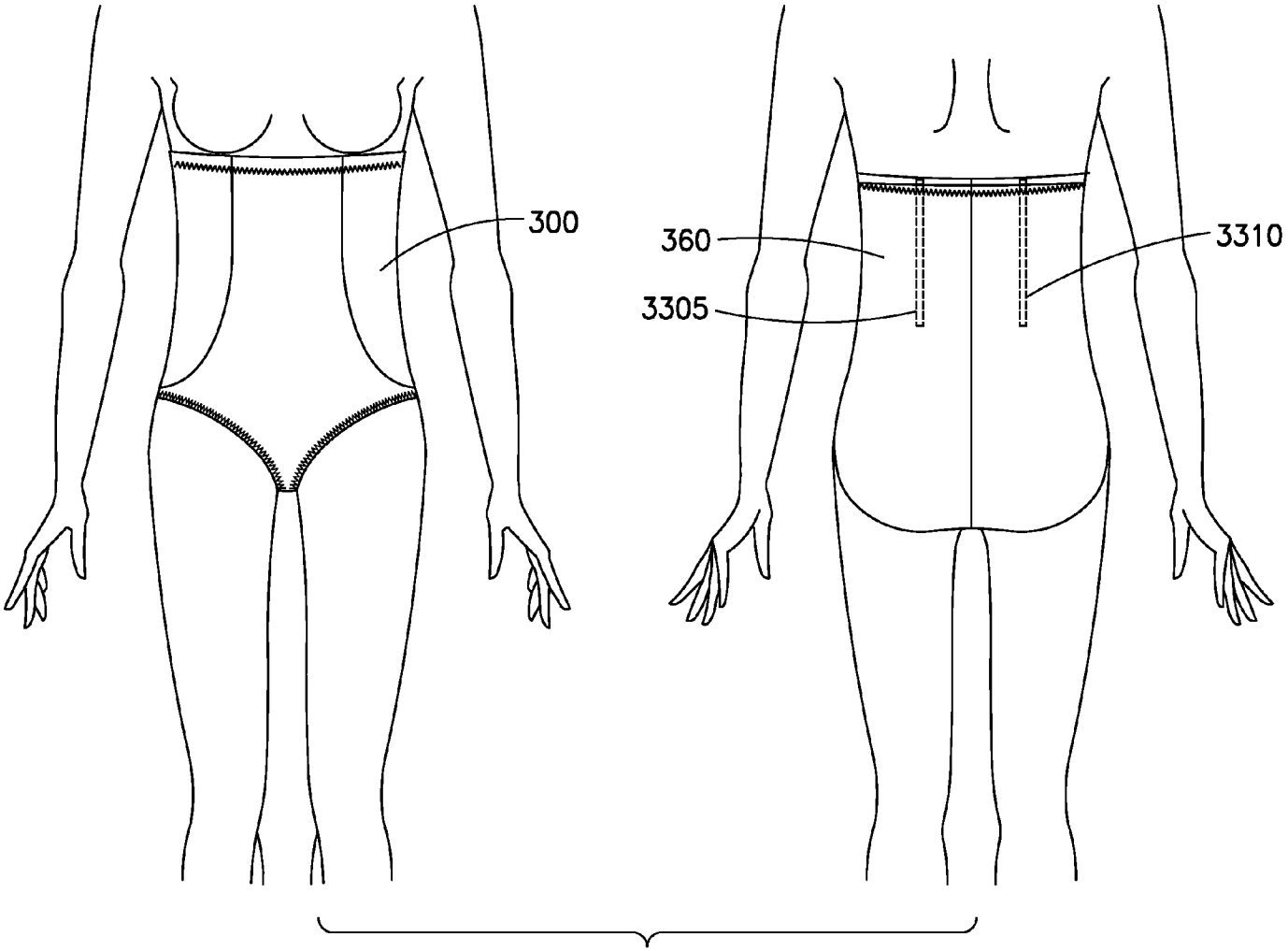
FIG. 12 are front and back views of the garment illustrated in FIG. 3 as worn.

FIG. 12 is front and back views of the garment 300, illustrated in FIG. 3, when worn. The casings 3305, 3310 with stays inside are illustrated in phantom in the back view of the garment when worn.

Figure 13:
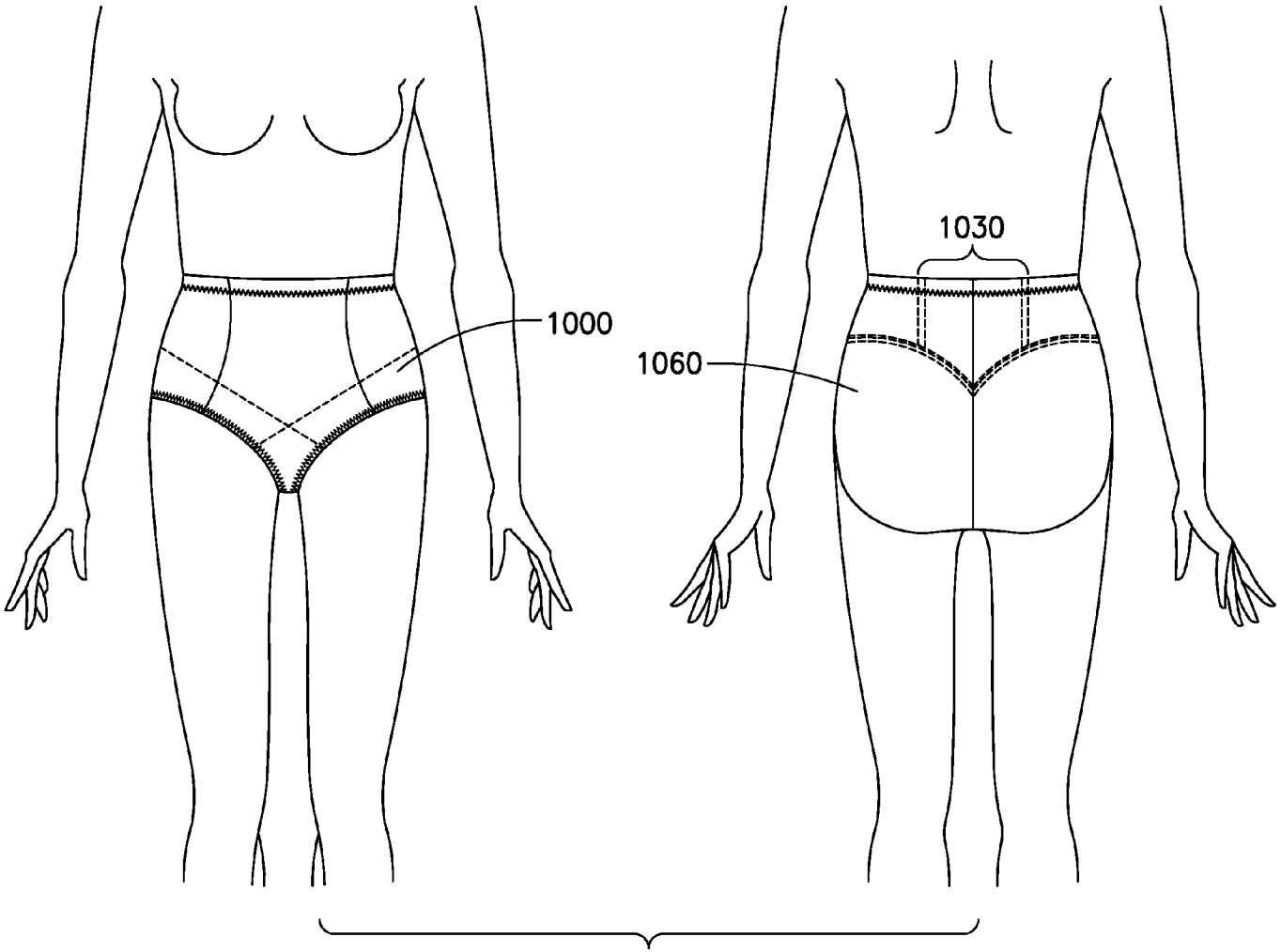
FIG. 13 are front and back views of the garment of FIG. 10 as worn.

FIG. 13 is front and back views of the waistline garment illustrated in FIG. 10, when worn. The casings 1030 with stays inside are illustrated in phantom in the back view of FIG. 13.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A garment comprising:

a smooth front fabric panel configured to rest on a front midsection of a wearer;

a back fabric panel configured to rest on a back of a wearer;

said front panel connected to said back panel;

at least one pair of stays supported by the garment, wherein the stays are located only in the back panel and wherein the stays are disposed in fabric casings such that the stay will not be in direct contact with the skin surface wearer whereby the stays pull the front panel of the garment thereby smoothing the front panel over the wearer's midsection.

2. The garment according to claim 1 wherein the stays are oriented lengthwise and are positioned such that, when worn, the length of the stay is approximately parallel to the spine of the wearer and wherein the stays are approximately parallel to each other.

3. The garment of claim 2 wherein the spine of a wearer is proximately equidistant from the first and second stays in the pair of stays.

4. The garment of claim 3 where the garment comprises a second pair of stays.

5. The garment according to claim 1, wherein the stays are spiral shaped.

6. The garment according to claim 1, wherein the stays are metal and each end of the metal stays has polymer disposed thereon.

7. The garment according to claim 1 wherein the stays are about 1 inch to about 7 inches in length.

8. The garment according to claim 7, wherein the garment is configured to cover the torso of the wearer and the stays are about 4 inches to about 7 inches in length.

9. The garment according to claim 1 wherein the garment further comprises casings for receiving the stays.

10. The garment according to claim 9 wherein the casings comprise filler material to cushion the stays.

11. The garment according to claim 1 further comprising a support panel supported by at least one of the front fabric panel and the back fabric panel.

12. The garment according to claim 9 wherein the stays are sewn into the casings.

13. The garment of claim 1 wherein the garment has a polymer feature disposed thereon such that the polymer feature is configured to contact the wearer when the skin surface of the garment is worn.

14. The garment of claim 13 wherein the polymer is silicone.

15. The garment of claim 13 wherein the polymer is located adjacent to an edge of the garment.

16. The garment of claim 15 wherein the polymer is located near a waist of the garment.

17. The garment of claim 15 wherein the edge is a bottom edge.

18. The garment of claim 1 wherein the front fabric panel and the back fabric panel are the same fabric.

19. The garment of claim 11 wherein, when worn, the stays are configured to be located in a flat region of the back of the wearer and span approximately from the waist of the wearer to the upper back of the wearer.

20. The garment of claim 11 wherein the back panel and the support panel are both stretchable material, wherein the support panel provides additional support to the wearer.

21. The garment of claim 7 wherein the stays are about 2 inches to about 4 inches in length and the garment is configured to be worn on the abdomen and the stays extend from a waist portion of the garment downward.

22. The garment of claim 1 wherein the garment is a strapless garment.

23. The garment of claim 22 wherein the garment is a strapless garment further comprising a brassiere portion.

24. A garment comprising:

a smooth front fabric panel configured to rest on a front midsection of a wearer;

a back fabric panel configured to rest on a back of a wearer;

said front panel connected to said back panel;

a support panel;

at least one pair of fabric casings capable of receiving stays, such casings being supported by at least one of the back fabric panel, the support panel, or both, and a stay disposed in each casing and wherein there are no stays disposed in or on the front fabric panel;

wherein the casings include filler material;

wherein the stays are sewn into the casings;

wherein the stays are about 1 inch to about 7 inches in length;

wherein the support panel is attached to the back fabric panel whereby the stays pull the front panel of the garment thereby smoothing the front panel over the wearer's midsection.

25. The garment according to claim 24, wherein the stays are spiral shaped.

26. The garment according to claim 24, wherein the stays are metal and each end of the metal stays is finished with silicone.

27. The garment according to claim 24, wherein the stays are about 2.5 inches to about 7 inches in length.

28. The garment according to claim 24 further comprising a silicone feature disposed on and supported by the back fabric panel such that the silicone feature is in contact with the skin surface of said wearer when the garment is worn.

29. The garment of claim 24, wherein the front panel and the back panel are made of the same fabric.

30. The garment of claim 24, wherein the front panel and the back panel are made of different fabrics.

31. A garment configured as a strapless brassiere comprising:

a smooth front fabric panel configured to rest on a front midsection of a wearer;

a back fabric panel configured to rest on a back of a wearer;

said front panel connected to said back panel;

a brassiere portion;

at least one pair of fabric casings capable of receiving stays, such casings being supported by at least one of the back fabric panels, and a stay disposed in each casing;

wherein the casings include filler material;

wherein the stays are sewn into the casings;

wherein the stays are about 1 inch to about 7 inches in length; and wherein all of the stays in the garment are supported by at least one of the back fabric panels.

32. A garment configured as a waistline garment comprising:

a smooth front fabric panel configured to rest on a front midsection of a wearer;

a back fabric panel configured to rest on a back of a wearer;

said front panel connected to said back panel;

at least one pair of fabric casings capable of receiving stays, such casings being supported by at least one of the back fabric panels, and a stay disposed in each casing;

wherein the casings include filler material;

wherein the stays are sewn into the casings;

wherein the stays are about 2 inches to about 4 inches in length; and wherein the stays are positioned on the garment such that, when the garment is worn, the stays are approximately equidistant from the spine of the wearer and all of the stays in the garment are supported by at least one of the back fabric panels.

* * * * *